United States Patent [19]

Theurer et al.

[11] 4,445,438

[45] May 1, 1984

[54] BALLAST TAMPING TOOL UNIT

[75] Inventors: Josef Theurer, Vienna; Johann Hansmann, Klosterneuburg, both of Austria

[73] Assignee: Franz Plasser Bahnbaumaschinen-Industriegesellschaft m.b.H., Vienna, Austria

[21] Appl. No.: 346,226

[22] Filed: Feb. 5, 1982

[30] Foreign Application Priority Data

Mar. 9, 1981 [AT] Austria ..... 1084/81

[51] Int. Cl.[3] ..... E01B 27/16

[52] U.S. Cl. ..... 104/12

[58] Field of Search ..... 104/7 R, 7 B, 10, 12

[56] References Cited

U.S. PATENT DOCUMENTS 3,621,786 11/1971 Joy ..... 104/12

3,998,165 12/1976 Jaeggi ..... 104/12

FOREIGN PATENT DOCUMENTS 2054708 2/1981 United Kingdom ..... 104/12

*Primary Examiner*—Randolph Reese

*Attorney, Agent, or Firm*—Kurt Kelman

[57] ABSTRACT

A tamping tool unit for a ballast tamping machine has a frame and a tamping tool unit carrier vertically adjustably mounted on the frame. The unit has a pair of tamping tool holders, each holder having affixed thereto a tamping tool for immersion in the ballast adjacent a point of intersection of a track tie and rail where the track is supported on the ballast. A transverse axle pivotally supports each tamping tool holder on the carrier and a hydraulic reciprocating drive pivots the tamping tool holders independently of each other and asynchronously towards and away from each other transversely to the track tie. Each axle is eccentrically supported to impart thereto a constant horizontal and vertical motion with respect to the carrier and a transmission connected to the eccentric axle supports and is arranged to cause the motions of the axles to be effected in opposite directions. A common vibrating drive is connected to one of the supports for rotating the same about an axis of rotation to impart to the axles revolving motions in opposite directions. The axes of rotation of the eccentric axle supports are so spaced from the axles that the axles move in orbits downwardly in the portions of the orbits facing each other whereby the lower ends of the tamping tools are vibrated in elliptical paths downwardly with respect to the track support point.

5 Claims, 5 Drawing Figures

BALLAST TAMPING TOOL UNIT

The present invention relates to improvements in a tamping tool unit for a ballast tamping machine which comprises a frame and a tamping tool unit carrier vertically adjustably mounted on the frame. The unit comprises a pair of tamping tool holders, each holder having affixed thereto a tamping tool for immersion in the ballast adjacent a point of intersection of a track tie and rail where the track is supported on the ballast, an axle pivotally supporting each tamping tool holder on the carrier, the axle extending transversely to the track, a hydraulic reciprocating drive means for pivoting the tamping tool holders independently of each other and asynchronously towards and away from each other, eccentric means imparting to each axle a constant horizontal and vertical motion with respect to the carrier, transmission means connecting the axles and arranged to cause the motions of the axles to be effected in opposite directions, and a common vibrating drive connected to the tamping tool carriers.

U.S. Pat. No. 3,998,165, dated Dec. 21, 1976, discloses a ballast tamping tool unit of this general type and comprising driven eccentric bushings rotatably mounted on the tamping tool unit carrier, the pivoting axles for the tamping tool holders being journaled in the bushings. This arrangement for the first time assured a guided motion of the tamping tool holders in relation to the carrier which is fixedly supported on the tamping machine frame by means of its vertical adjustment drive and thus forces the tamping tool holders to effectuate a constant and periodic vertical and horizontal movement of the same amplitude in relation to the carrier, producing substantially elliptical or circular vibratory motions. This forced vibration of the tamping tools enables them to penetrate more readily into hard and encrusted ballast beds when the tamping tool unit is lowered for immersion of the tamping tools into the ballast, thus reducing the power required for lowering the unit. The patent also discloses means for vibrating the tamping tools when the unit is lowered while the vibration is stopped when the unit is raised. This prevents the tamped ballast from being loosened again and avoids possible difficulties when the tamping tools are lifted out of the tamped ballast.

British patent application No. 2,054,708 A, published Feb. 18, 1981, discloses various embodiments of a similar ballast tamping tool unit functioning in a like manner. The pivoting axles for the tamping tool holders are force-fitted on an eccentric surface of a rotary shaft journalled in the carrier housing of the unit so that the vibratory motions of the tamping tools of each pair may be effectuated in opposite directions. There is no recognition of any concept that there is an essential difference in the function of the vibrating tamping tools between vibrating them in the same or in opposite directions.

It is the primary object of this invention to improve on a ballast tamping tool unit of the above-described type in such a manner that the tamped ballast support for the track remains undisturbed at the end of the tamping operation.

The above and other objects are accomplished in accordance with the invention with a vibrating drive arranged to impart to the axles pivotally supporting each tamping tool holder revolving motions in opposite directions and in orbits wherein the axles move downwardly in the portions of the orbits facing each other whereby the lower ends of the tamping tools are vibrated in elliptical paths downwardly with respect to the track support point of intersection of a track tie and rail.

This arrangement forces the opposite vibratory motions of the tamping tools to be directed always essentially in the direction of the tamped track support so that the tamped ballast there cannot be loosened or disturbed when the tamping tools are lifted out of the ballast bed at the end of tamping operation. For the first time, we have recognized it to be essential so to arrange the vibrating drive for the tamping tool holders that the opposite vibrations thereof are directed towards the tamped ballast track support under the point of intersection of a track tie and rail, and are directed downwardly in their elliptical or circular orbits, rather than the other way around.

The above and other objects, advantages and features of the invention will become more apparent from the following detailed description of certain now preferred embodiments thereof, taken in conjunction with the somewhat schematic drawing wherein FIG. 1 is a side elevational view of one embodiment of the tamping tool unit of the present invention;

Figure 2:
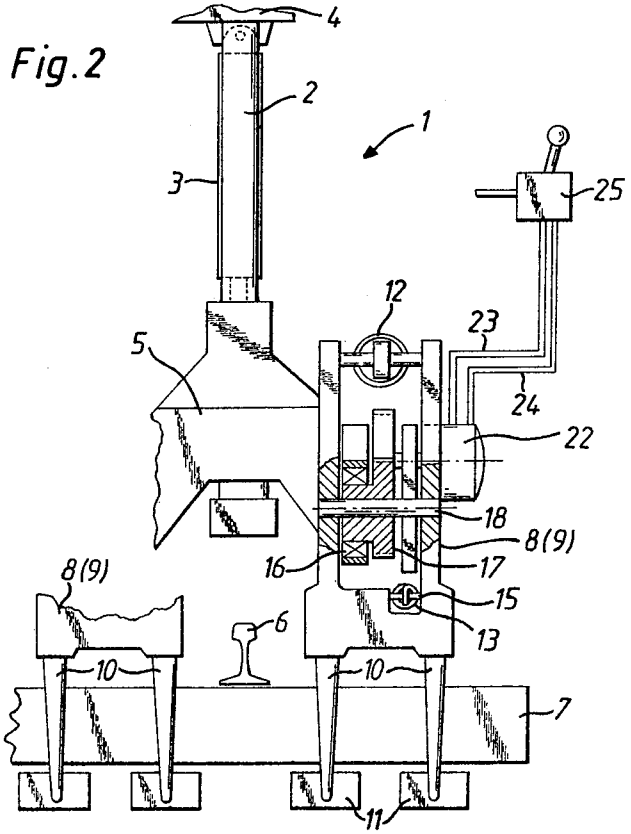
FIG. 2 is a front elevational view, partly in section, of the unit of FIG. 1, seen in the direction of arrow II.
Figure 1:
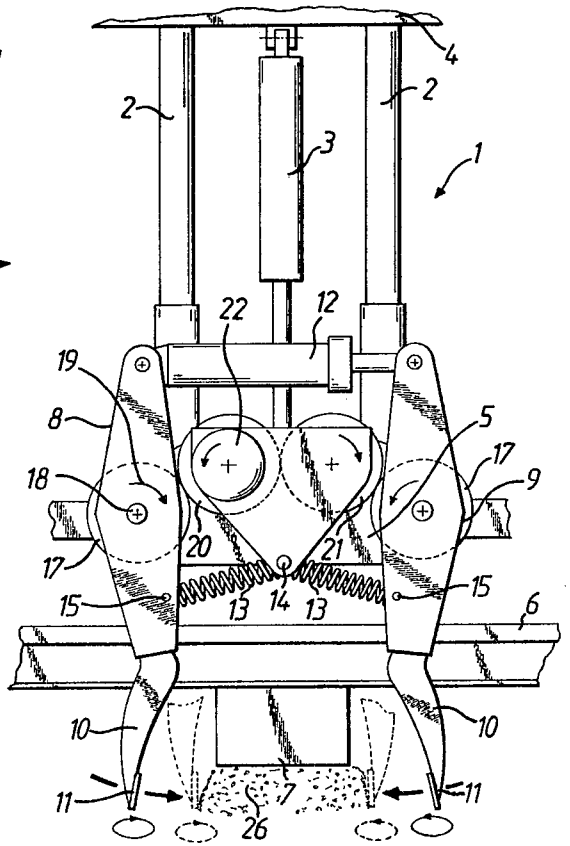

Referring now to the drawing and first to FIGS. 1 and 2, there is shown tamping tool unit 1 for a ballast tamping machine which comprises frame 4 and tamping tool unit carrier 5 vertically adjustably mounted on the frame. The carrier is glidably supported on the frame by guide columns 2 and vertically movable therealong by hydraulic drive 3. The unit comprises a pair of tamping tool holders 8, 9 at the gage side and the field side of each rail 6 of the track, and each holder has affixed thereto tamping tool 10 with tamping jaw 11 for immersion in the ballast adjacent point of intersection 26 of track tie 7 and rail 6 where the track is supported on the ballast. During the tamping, tie 7 is positioned between the tamping tools of each pair. Axle 18 pivotally supports each tamping tool holder 8, 9 on carrier 5, the axle extending transversely to the track. Hydraulic reciprocating drive 12 is linked to the upper ends of the double-armed tamping tool holders of each pair for pivoting the tamping tool holders independently of each other and asynchronously towards and away from each other. This type of ballast tamping arrangement is very well known in the art. The reciprocable tamping tool holders of each pair are centered with respect to the center of unit 1 by two tension springs 13 whose inner ends are anchored to transverse bolt 14 on carrier 5 substantially centered above tie 7 to be tamped while their outer ends are attached to pins 15 on respective tamping tool holders 8, 9.

The arrangement of a single reciprocating drive for each pair of tamping tool holders and their centering over the tie to be tamped further improves the power distribution to the tamping tools during the tamping operation and considerably simplifies the structure of the unit. It further enables the vibratory motions of each tool to adapt to the particular ballast conditions, especially in encrusted ballast beds.

In this embodiment and as shown in FIG. 2, tamping tool holders 8, 9 are supported on tamping tool unit carrier 5 in the following manner to provide eccentric means imparting to each axle 18 a constant horizontal and vertical motion with respect to the carrier and transmission means connecting the axles and arranged to cause the motions of the axles to be effected in opposite directions:

Gear 17 is rotatably journalled in roller bearing 16 on carrier 5 and this gear has an axially extending eccentric bore which rotatably holds stub axle 18 rigidly affixed to the tamping tool holder. Thus, the gear constitutes a driven eccentric bushing for the tamping tool holder axle, which is rotatably mounted on carrier 5. When the gear is rotated in the direction of arrow 19 (see FIG. 1), it imparts to axle 18 a forced horizontal and vertical motion with respect to the carrier, which vibratory motion runs downwardly in an elliptical or circular orbit. To cause the motions of the axles to be effected in opposite directions, gears 17 are connected by two meshing transmission gears 20, 21 rotatably journalled on carrier 5. Hydraulic motor 22 is affixed to gear 20 to enable gear drive 20, 21 to be operated for rotation of gears 17.

As shown in FIG. 2, conduits 23, 24 connect hydraulic motor 22 to control 25 built into the hydraulic system of the ballast tamping machine so that the direction of rotation of the hydraulic motor may be reversed. In this manner, hydraulic motor 22 connected to one pivoting axle 18 constitutes a vibrating drive for both tamping tool holders arranged to impart to the axle connected to the drive a revolving motion in an orbit wherein the axle moves downwardly in a portion of the orbit facing towards the center of the unit. This arrangement is relatively simple and provides a space-saving construction.

FIG. 1 illustrates the end positions of reciprocation of tamping tools 10 as they tamp ballast 26 supporting the track at the point of intersection of rail 6 and tie 7, the elliptical orbits of the vibratory motions always moving towards ballast support 26 and downwardly in relation thereto being also indicated in the elliptically shaped arrows. The direction of vibration of the tamping tools has the effect that, after tamping has been concluded and the tamping tools are raised out of the ballast, the tamped ballast is not loosened because tamping jaws 11 continue to press the ballast inwardly and downwardly, thus imparting additional compaction to ballast support 26.

Figure 3:
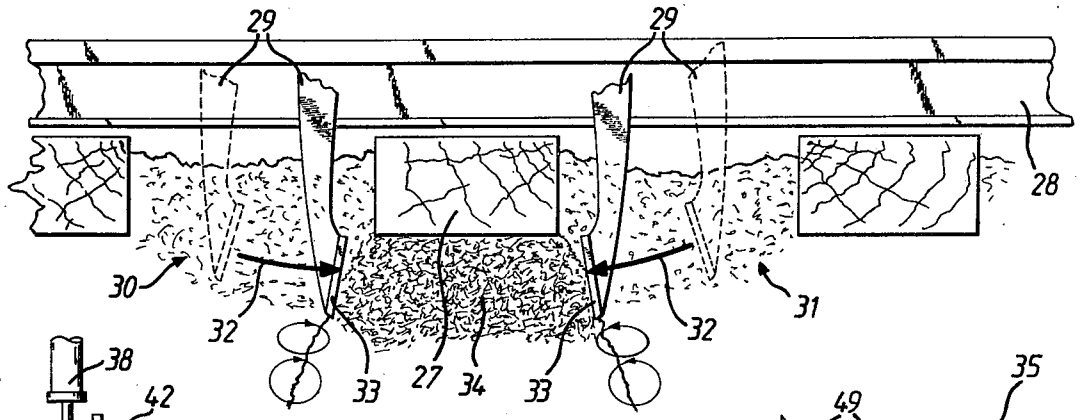
FIG. 3 is an enlarged side view of a tamped ballast track support, with the tamping tools in their operating position.

The tamping conditions attained with the tamping tool unit of the present invention is highlighted in the enlarged showing of FIG. 3. After tamping tools 29 are immersed in cribs 30 and 31 adjacent tie 27 supporting rail 28, they are reciprocated in the direction of arrows 32 while being vibrated in the manner schematically indicated by the elliptical arrows. This causes tamping jaws 33 to produce a very dense and compact track support 34, due to the continuing vibratory inward pressure exerted by the tamping jaws and their downward motion in the portion of their orbit adjacent support 34. The vibratory force extends always substantially perpendicularly to the desired contour of tamped ballast track support 34.

Figure 4:
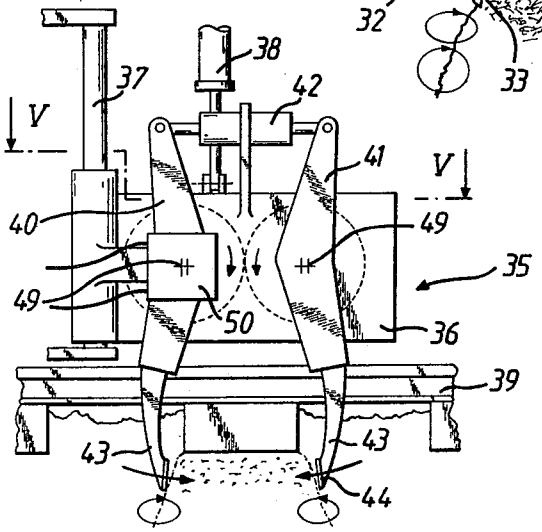
FIG. 4 is similar to FIG. 1, showing another embodiment of the tamping tool unit.
Figure 5:
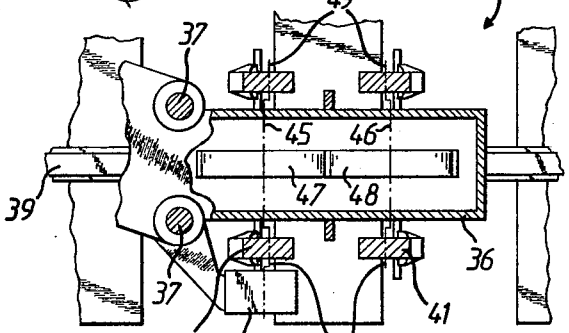
FIG. 5 is a section along line V—V of FIG. 4.

In the embodiment illustrated in FIGS. 4 and 5, tamping tool unit 35 comprises carrier 36 constituted by a housing which is vertically glidably mounted on guide columns 37 of the ballast tamping machine frame and may be vertically adjusted by hydraulic drive 38. As in the first-described embodiment, a pair of tamping tool holders 40, 41 carrying tamping tools 43 with tamping jaws 44 is mounted on the carrier on the field side and the gage side of each rail 39 of the track. Again, a single hydraulic reciprocating drive 42 is linked to the upper ends of the tamping tool holders of each pair. Axle 49 supports each tamping tool holder pivotally on carrier 36. Two rotary shafts 45, 46 extend transversely to the track through carrier housing 36 and the ends of these shafts projecting beyond the carrier housing are cranked to form axles 49, thus constituting eccentric means imparting to each axle a constant horizontal and vertical motion with respect to carrier 36. Meshing transmission gears 47, 48 are keyed to rotary shafts 45, 46 so that the motions of axles 49 are effected in opposite directions, as indicated by the arcuate arrows in FIG. 4 indicating the driving directions of the transmission gears. The outermost end of crank shaft 45 carries hydraulic motor 50 and a bracket connects the motor to carrier 36.

What is claimed is:

1. A tamping tool unit for a ballast tamping machine which comprises a frame and a tamping tool unit carrier vertically adjustably mounted on the frame, the unit comprising (a) a pair of tamping tool holders, each holder having affixed thereto a tamping tool for immersion in the ballast adjacent a point of intersection of a track tie and rail where the track is supported on the ballast, (b) an axle pivotally supporting each tamping tool holder on the carrier, the axle extending transversely to the track, (c) a hydraulic reciprocating drive means for pivoting the tamping tool holders independently of each other and asynchronously towards and away from each other transversely of the track tie, (d) eccentric means supporting each axle and imparting thereto a constant horizontal and vertical motion with respect to the carrier upon rotation of the eccentric means about an axis spaced from the axle, (e) transmission means connecting the eccentric axle supporting means and arranged to cause the motions of the axles to be effected in opposite directions, and (f) a common vibrating drive connected to one of the eccentric axle supporting means for rotating the same about said axis to impart to the axles revolving motions in opposite directions, the axes of rotation of the eccentric axle supporting means being so spaced from the axles that the axles move in orbits downwardly in the portions of the orbits facing each other whereby the lower ends of the tamping tools are vibrated in elliptical paths downwardly with respect to the track support point.

2. The tamping tool unit of claim 1, wherein the eccentric means comprises a driven eccentric bushing for each axle and rotatably mounted on the carrier.

3. The tamping tool unit of claim 1, wherein the eccentric means comprises an eccentric shaft journalled on the carrier and driven by the vibrating drive, the axle forming an extension of the shaft.

4. The tamping tool unit of claim 1, wherein the transmission means comprises a gear drive.

5. The tamping tool unit of claim 1, wherein the vibrating drive is a hydraulic motor.

* * * * *